US005107305A

United States Patent [19]

Charland et al.

[11] Patent Number: 5,107,305

[45] Date of Patent: Apr. 21, 1992

[54] CLEANING MECHANISM AND METHOD HAVING PARTICLE FLOW GUIDES

[75] Inventors: Michael R. Charland; Francisco L. Ziegelmuller, both of Penfield, N.Y.

[73] Assignee: Eastman Kodak Company, Rochester, N.Y.

[21] Appl. No.: 621,203

[22] Filed: Dec. 3, 1990

[51] Int. Cl.[5] ..... G03G 21/00

[52] U.S. Cl. ..... 355/298; 15/256.52; 220/501; 355/296; 355/299

[58] Field of Search ..... 15/1.5, 104.8, 256.52, 15/257.4; 220/501; 229/120.35, 120.23, 120.12; 355/298, 299, 296

[56] References Cited

U.S. PATENT DOCUMENTS

| | | | |
|---|---|---|---|
| 4,436,414 | 3/1984 | Kamiyama et al. | 355/298 |
| 4,530,594 | 7/1985 | Adachi | 355/299 |
| 4,803,511 | 2/1989 | Izzo | 355/211 |
| 4,870,449 | 9/1989 | Brown | 355/297 |

FOREIGN PATENT DOCUMENTS

| | | | |
|---|---|---|---|
| 0203479 | 11/1983 | Japan | 355/298 |
| 0625503 | 6/1949 | United Kingdom | 220/501 |

*Primary Examiner*—A. T. Grimley
*Assistant Examiner*—J. E. Barlow, Jr.
*Attorney, Agent, or Firm*—Tallum I. Nguti

[57] ABSTRACT

A mechanism for cleaning an image-bearing surface in an electrostatographic apparatus includes an elongate container for receiving and holding toner and other particles removed from such surface. The container which includes a sump that has a front portion and a rear portion, is liftable from a first and generally horizontal position, to a raised, second and partially upended position on one end. The sump of the container includes slanted flow guides therein for moving toner and other particles from the front portion to the rear portion thereof by lifting the container from the first position to the second position.

22 Claims, 3 Drawing Sheets

FIG. 4
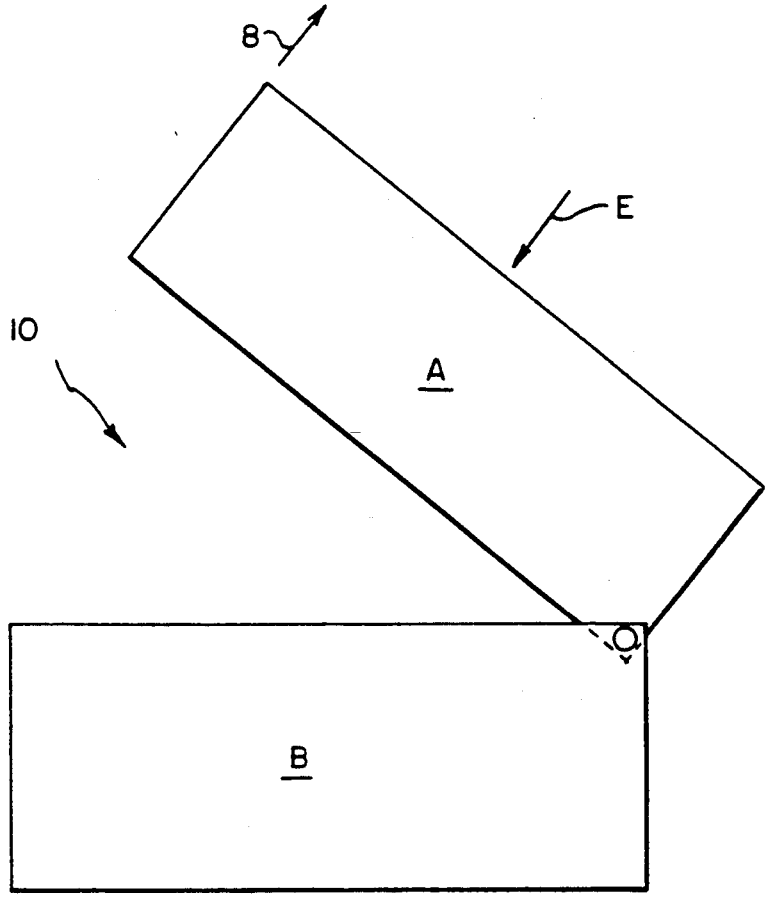
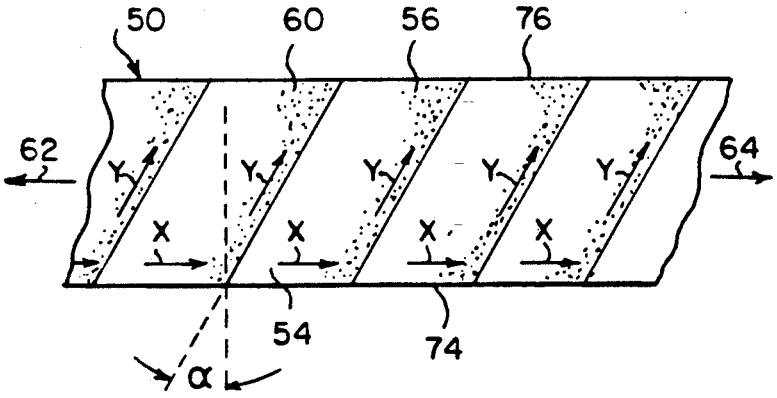
FIG. 5

CLEANING MECHANISM AND METHOD HAVING PARTICLE FLOW GUIDES

BACKGROUND OF THE INVENTION

1. Field of the Invention

The present invention relates to cleaning devices, and more particularly to such a device which is usable in an electrostatographic apparatus for effectively and safely removing residual toner particles from an image-bearing surface therein.

2. Description Relative to the Prior Art

Electrostatographic process apparatus, which for example produce or reproduce toned images on selected substrates by employing electrostatic charges and toner particles on an insulated photoconductive surface, typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with particles of toner, (4) transferring the toned image to a suitable substrate for fusing thereon to form a permanent record, and (5) cleaning by removing residual toner and/or other particles from the photoconductive surface in preparation for similarly producing another image.

The quality of the images produced by such apparatus depends significantly on the ability to clean the photoconductive surface before it is reused. Several types of cleaning mechanisms, including blade-type cleaners, have therefore been developed for cleaning the photoconductive and other image-bearing surfaces in such apparatus. The long-term effectiveness of any such cleaning mechanism, however, depends significantly on its ability to move and hold (away from the surface being cleaned) the toner and other particles it removes from such surface.

As electrostatographic process apparatus become more and more compact, and more and more competitive in their price and quality aspects, there is a need for simple and inexpensive cleaning mechanisms that can remove, move, and hold toner and other particles away from the image-bearing surface of such an apparatus. Without such a mechanism, residual toner particles being cleaned into a container will ordinarily accumulate in one portion of the container resulting in premature failure of the cleaning apparatus, and even in contamination and poor image quality.

Additionally, in electrostatographic apparatus of the type having an upper assembly portion that is movable pivotably relative to a lower assembly portion, as disclosed, for example, in U.S. Pat. No. 4,803,511, issued Feb. 7, 1989, in the name of Izzo, there is a tendency of toner and other particles, being caused by the pivoting movement of the upper portion, to unevenly accumulate within the cleaning mechanism. Such uneven accumulation ordinarily can result in spills as well as in undesirable contamination within the apparatus. In this latter type of electrostatographic apparatus, there is the additional need to prevent such uneven accumulation.

SUMMARY OF THE INVENTION

It is an object of the present invention to provide a simple and inexpensive cleaning mechanism that effectively removes toner and other particles from an image-bearing surface, and that includes a device for moving and holding such toner particles away from such surface.

It is also an object of the present invention to provide such a cleaning mechanism that prevents uneven accumulation of such toner and other particles therein when the cleaning mechanism is partially upended on one of its ends.

In accordance with the present invention, there is provided a cleaning apparatus for cleaning a surface in an electrostatographic apparatus. The cleaning apparatus includes a housing for enclosing the electrostatographic apparatus that has a top housing portion thereto which is movable relative to a bottom housing portion thereto. The cleaning apparatus also includes means for removing particles from the surface being cleaned, and means defining a container within the housing for accumulating a pile of particles removed from such surface. The cleaning apparatus further includes means for moving the container in response to movement of the top housing portion so as to reduce the level of the particle pile adjacent the particle removing means.

In accordance with another aspect of the present invention, there is provided a method for cleaning a surface in an electrostatographic apparatus having a movable housing member providing access to components therein. The method comprises operating a device for removing residual particles from a surface being cleaned, collecting the removed particles in a collection container to form a pile in a first portion of the container, and then reducing the level of the pile so formed in response to movement of the movable housing member so as to move the collected particles from the first portion to a second and different portion of the container.

BRIEF DESCRIPTION OF THE DRAWINGS

In the detailed description of the preferred embodiment of the invention presented below, reference is made to the accompanying drawings, in which:

FIG. 4 is a schematic of the housing of the apparatus of FIG. 1 showing a top portion thereof, to which the cleaning apparatus of the present invention is attached, in a raised position relative to a bottom portion thereof; and FIG. 5 is a view of the container of FIG. 3 as viewed in the direction of arrow E of FIG. 4 and having certain details omitted to illustrate particle flow when the container is moved to a raised position.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
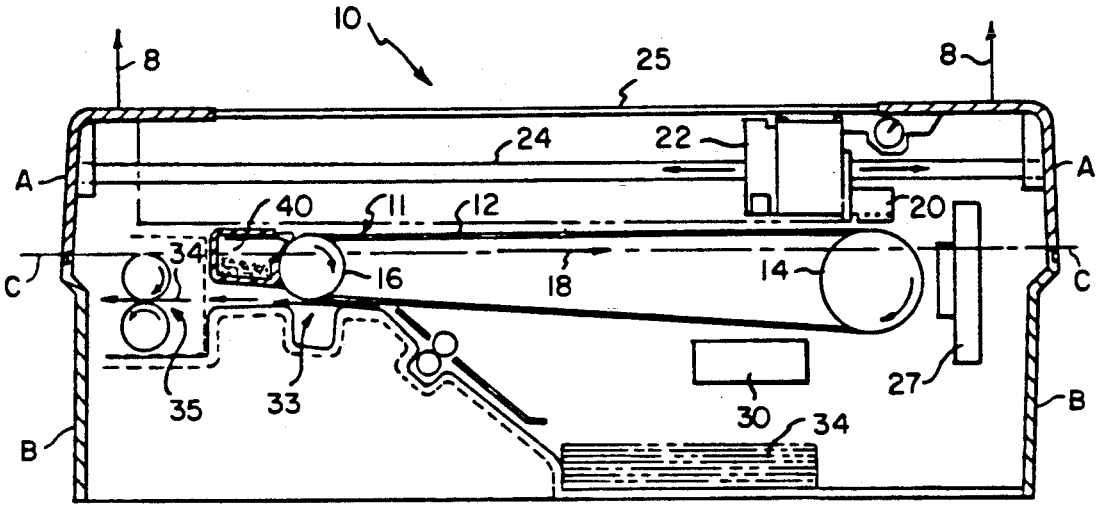
FIG. 1 is a schematic of an electrostatographic apparatus embodying the cleaning apparatus of the present invention.

Referring now to FIGS. 1 and 4, an electrostatographic apparatus such as a copier or printer shown generally as 10 can be the type having a housing including a top housing member or portion A that is pivotably connected to and movable relative to a bottom housing member or portion B. The housing portions A, B close together, for example, along a line C. As shown, the top housing portion A is hinged at the back edge (into the sheet) thereof, and is pivotable upwardly as per the arrows shown as 8. Such lifting of the top housing portion A can occur when an operator clears a jam or performs other services within the apparatus 10.

The copier or printer 10 includes a moving image-bearing member 11 shown in the form of an endless belt having an image-bearing surface 12. Member 11 is trained about rollers 14, 16 for movement in the direction indicated by the arrow 18. One of the rollers such as 14 can be a drive roller for moving the member 11. Alternatively, the member 11 can be a rigid drum that has an image-bearing surface 12 and is rotatable about its axis in the direction as shown by the arrow 18. The copier or printer 10 also includes a primary charger 20 shown as an integral part of a scanner assembly 22 that travels back and forth on a member 24. The primary charger 20 deposits electrostatic charges uniformly on the moving image-bearing surface 12, and the scanner 22 forms electrostatic images therefrom by imagewise exposing the charged surface 12 to light reflected from a document positioned on a platen 25. Electrostatic image patterns can also be formed on the moving charged surface 12 by means of an electronic printhead shown as 27.

The electrostatic images formed thus, next move past a development station 30 where they are developed or made visible by attracting and holding charged toner particles. The visible images then move to a transfer station 33 where they are transferred to suitable receivers or substrates such as copy sheets of paper 34. After such transfer, the image-bearing member 11 continues in its path about the rollers 14, 16 and the copy sheet of paper is moved to a fusing station 35 where the toner particle image is fused thereon to form a permanent copy of the original image.

Figure 2:
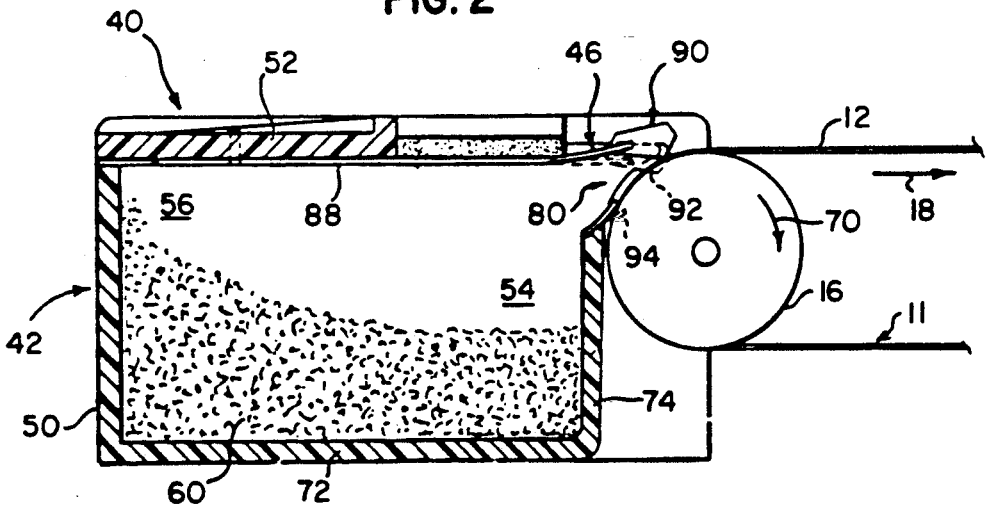
FIG. 2 is an enlarged cross-sectional view of the cleaning apparatus of the present invention.

Because the quality of the copies produced in this manner depends significantly on the cleanliness of the image-bearing surface 12, the path of the image-bearing member about the rollers 14, 16 includes a cleaning station, generally designated 40. Referring now to FIGS. 2 and 5, the cleaning apparatus 40 consists of a cleaning subassembly shown as 42. The subassembly 42 which is suitable for mounting against a surface such as 12 being cleaned, can be a self-cotained cartridge. The subassembly or cartridge 42 includes (a) a cleaning element 46 for removing particles, such as particles of waste toner, from the surface 12 being cleaned, and (b) an elongate container 50 that has a cover 52, and two interior portions, a front portion 54 and a rear portion 56, which are suitable for receiving and holding waste toner particles shown as 60. As further shown, the container 50 has a first end 62 and a second 64. Support bosses or projections 75 are formed at each end 62,64 for fitting within complimentary recesses in the top housing portion A. When mounted and supported as such in the apparatus 10 of FIGS. 1 and 4, the container 50 is attached to the upper portion A for movement therewith such that the second end 64 thereof is towards the hinged or back edge of the housing portion A while the first end 62 is towards the front or upwardly pivotable edge of the portion A.

As also shown, the front and rear portions 54, 56 of the container 50 form a sump that is defined by a base 72, a short front wall 74, a back wall 76, end walls 77, 78, and the cover 52. The short front wall 74 and the cover 52 also define an opening 80 above such front wall into the front portion 54. As shown, particularly in FIGS. 1 to 3, the container 50 has a generally horizontal position when receiving waste or residual particles being removed from the surface 12. As illustrated in FIG. 4, the container 50 also has a second position when it is moved pivotably with the top portion A of the copier or printer 10. As mounted, the container 50 will be partially upended on its second end 64 when in such second and upraised position of FIG. 5.

Figure 3:
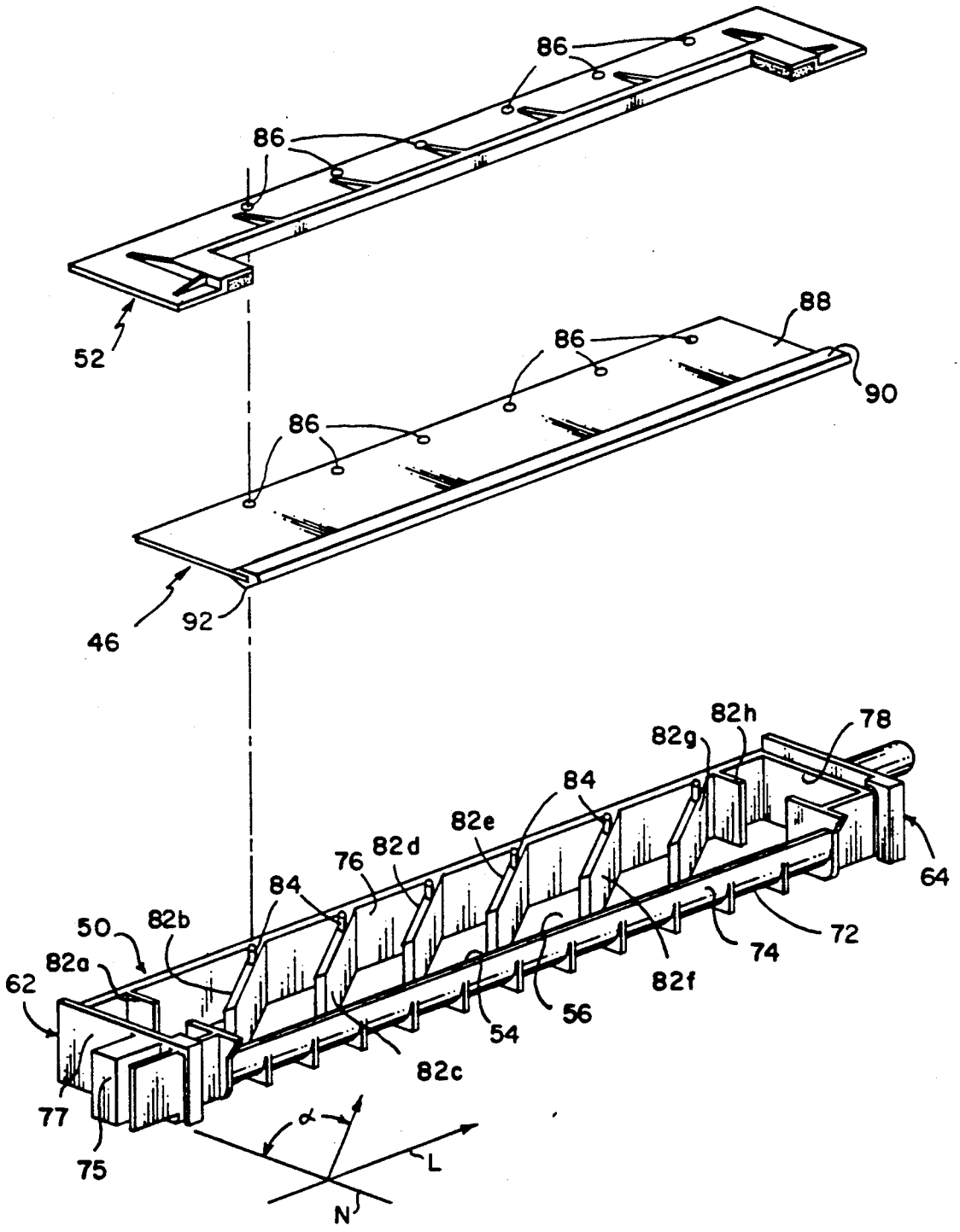
FIG. 3 is an exploded perspective view of the cleaning element and the container for receiving and holding removed particles, showing the particle flow guides of the present invention.

Referring now to FIGS. 2 and 3, the cleaning element 46 consists of a support portion 88, and a cleaning tip 90. As shown, the cleaning element 46 is mounted and supported in the cartridge 42 such that the cleaning tip 90 projects beyond the front wall 74 of the container 50 through the opening 80. The cleaning tip 90 has a cleaning edge 92 that is suitable for removing toner and other particles from a surface such as an image-bearing surface 12. The support portion 88 of cleaning element 46 is flexible and will allow the cleaning tip 90 to flex upwards and slightly backwards when the cartridge 42 is mounted against a member to be cleaned, such as the member 11 (FIG. 2), and when the cleaning edge 92 is in contact with the surface being cleaned, for example, with the surface 12 (FIG. 2).

When the cartridge 42 is mounted for operation, waste toner and other particles will be removed from the surface 12, as the surface 12 moves upwardly as shown, against the edge 92. The removed particles then conveniently fall by gravity through the opening 80 into the front portion 54 of the container or housing 50. A very thin flexible pick-up blade 94, which is attached to the top of the front wall 74 to form the bottom edge of the opening 80, and which normally projects beyond the front wall 74, is also flexed upwards and backwards by the surface 12, upon the mounting of the cartridge 42. When flexed as such, the pick-up blade 94 acts as a seal against the surface 12, and thus directs all waste particles removed by the cleaning edge 92 to fall into the front portion 54.

As it is to be expected, unless the waste toner particles falling by gravity into the front portion 54 are moved out of, and away from such front portion, such particles will soon accumulate thereat, building up in the form of a wedge against the surface 12, and will shortly thereafter render the action of the cleaning tip 92 undesirably ineffective. In general, it should be understood that waste toner particles removed by a cleaning tip such as 92, and allowed to fall gravitationally into any container, will similarly accumulate directly below the cleaning tip, and will similarly render the action of such a cleaning tip undesirably ineffective within a short period.

In the present invention, in order to prevent undesirable accumulation and cleaning ineffectiveness of the cleaning element 46, particle moving means consisting of partition walls or baffles 82*a*, 82*b* . . . 82*h* are provided between the front wall 74 and back wall 76 of the container 50. Each partition member or baffle 82*b* . . . 82*g* has a vertically extending stub pin 84 at its top. As shown in FIG. 3, the cleaning element 46 and the cover 52, are mounted on and supported by the partition members 82*a*, 82*b* . . . 82*h*, by means of the stub pins 84 which fit through corresponding pin holes 86 formed in the cleaning element support section 88, and in the cover 52. To form the self-contained cartridge 42, the ends of the stub pins 84 are thereafter ultrasonically welded to the cover 52 after the cleaning element and such cover have been assembled thereto.

The baffles 82*a* . . . 82*h* serve to define compartments within the container 50 for breaking up or dividing the accumulation of waste toner particles 60 end-to-end within the container 50. As such, pivotably and partially upending the container 50 on either end will not result in an over accumulation of such waste toner particles 60 at the one end. The partitions 82*a* . . . 82*h* will each serve as such to hold a small and proportionate quantity of such waste toner particles 60 that had dropped gravitationally from the cleaning edge 92 into the front sump portion 54 adjacent each such partition. As a result of such partitions, spills and undesirable contamination are therefore prevented in the copier or printer 10, when the container 50 is upended on its second end R by pivotably lifting it along with the top portion A of the copier or printer 10.

More importantly, in the present invention, the partitions or baffles 82*a* . . . 82*h* are mounted within the sump of the container 50 such that each such baffle 82*b* . . . 82*g* has a slant thereto that extends from the front portion 54 to the rear portion 56 of the sump. As shown in FIGS. 3 and 5, the slant of each such baffle 82*b* . . . 82*g* has a slope towards the second end 64 of the container 50 as viewed relative to a perpendicular or normal line N drawn to the front wall 74 of the container 50 or, as shown, perpendicular or normal to a line L which is parallel to the front wall 74. Since ordinarily the back wall 76 is also parallel to the front wall 74, the line N will ordinarily also be a normal or perpendicular between the front and rear portions 54, 56 of the sump of the container 50.

Given the mounting of the container 50 in the copier or printer 10, the slant of each baffle 82*b* . . . 82*g* from the front wall 74 to the back wall 76 can also be seen as being towards the hinged or pivot edge of the top portion A. As shown, each baffle 82*b* . . . 82*g* is slanted, as such, at an angle $\alpha$ of about 30°. It has been found that a layer angle such as one approaching 60°, is not very effective. The same is true of angles less than 30°.

Mounted as such, each slanted baffle 82*b* . . . 82*g* effectively operates as a ramp or simple means for moving the residual or waste toner particles 60 from the front portion 54 into the rear portion 56 of the container 50 when the container 50 is pivotably moved from its first and generally horizontal position FIGS. 1-3, to its second and partially upended position FIG. 5. As shown, in FIGS. 4 and 5, when the top housing portion A is pivotably upraised as shown, waste toner particles 60 within the container 50 will flow within and between the sump portions 54, 56 thereof in the manner indicated by the arrow patterns X and Y. As shown, in each section between adjacent partitions, the particles 60 will first flow gravitationally in the direction of the arrow X, from the upraised end 62 side of each such section down towards the lower end of the section. At the same time, because of the built-in slant or slope of each baffle or partition 82*b* . . . 82*g*, the flowing particles 60 will not merely accumulate along such downstream partition of the section, but will additionally flow against such partition in the direction of the arrow Y, thereby flowing from the front portion 54 to the rear portion 56 of the sump. The angle $\alpha$ of each slant is selected such that returning the top housing portion A from the raised position of FIG. 4 to the down position, and which thus returns the container 50 from the upended position FIG. 5 down to its first and horizontal position, will ordinarily not result in a significant reshifting of the particles 60 from the rear portion 56 back to the front portion 54. When the container 50 is substantially filled, the cartridge 42 can then be removed and a new one remounted in its place.

As can be seen, the cleaning mechanism 40 of the present invention includes simple and inexpensive means for moving the residual or waste toner particles 60 away from the front portion 54 (which is adjacent the surface 12), to the rear portion 56 of the container 50. Such front-to-back or rear movement is achieved simply by moving the top housing portion A from its down position to its upraised position. The particle moving means which consists of the slanted particle flow guides 82*b*. . . 82*g* also serves to prevent uneven accumulation at one end of the container 50 when the container is partially raised or upended on such end by lifting the top portion A of the copier or printer 10. Undesirable contamination within the copier or printer 10 is therefore prevented, as well as is undesirable ineffective cleaning due to a pile up of waste toner particles 60 in the front portion 54, and against the surface 12 being cleaned.

A cleaning device has been shown having slanted partition walls 82*b* . . . 82*g* in a toner receiving container 50 for causing movement of residual toner 60 away from a front portion 54 of the container 50 where toner enters and tends to collect. Such partition walls 82*b* . . . 82*g* each serve as a ramp for guiding the movement of the residual toner away from the front portion 54 when a top housing portion A to which the container is mounted is pivoted about a point near one end 64 of the container. In its broader aspects, the invention contemplates that the pivoting action of such housing portion A may be along an axis parallel to the back wall 76 of container 50 at the left end of the housing as shown in FIG. 1. In such case, the partition walls 82*b* . . . 82*g* need not be slanted.

The invention has been described with reference to cleaning of an image-bearing member. However, the device as described herein may be used for cleaning other surfaces such as the surfaces of a magnetic brush or that of cleaning rollers, etc.

The invention has been described in detail with particular reference to a presently preferred embodiment, but it will be understood that variations and modifications can be effected within the spirit and scope of the invention.

What is claimed is:

1. A device for cleaning a surface in an electrostatographic apparatus, the cleaning device including:

(a) an elongate container for receiving and holding residual toner and other particles, said container having first and second ends, a sump including front and rear portions thereof;

(b) a cleaning element for removing residual toner and other particles from the surface such that such residual toner and other particles are received into said front portion of said sump;

(c) means supporting said container for movement; and (d) means, including a slanted baffle, for moving such residual toner and other particles from said front portion of said sump into said rear portion thereof in response to movement of said container.

2. The cleaning device of claim 1 wherein said slanted baffle has a slant extending from said front portion to said rear portion of said sump, thereby forming a particle flow baffle.

3. The cleaning mechanism of claim 2 wherein said slant of said baffle has a direction towards said second end of said container from a perpendicular between said front and rear portions of said sump.

4. The cleaning mechanism of claim 3 including a plurality of said baffles.

5. The cleaning mechanism of claim 3 wherein said baffle is slanted at an angle of about 30° from said perpendicular.

6. The cleaning apparatus of claim 5 wherein said baffle is slanted at angle within the range of 30°-60°.

7. A container, for use in an electrostatographic cleaning mechanism, for receiving and holdind residual toner particles, said container having:

(a) a first end and a second end;

(b) a sump, including a front portion and a rear portion thereto;

(c) means for moving residual toner and other particles from said front portion of said sump into said rear portion thereof in response to change of orientation of said container relative to gravity by lifting said container from said first position into said second position, said moving means including a plurality of baffles each having a slant extending from said front portion to said rear portion of said sump.

8. The container of claim 6 wherein the slant of each said baffle, relative to a perpendicular between said front and rear portions, is towards said second end of said container.

9. The container of claim 8 wherein each said slant is at an angle within the range of 30°-60° from such perpendicular.

10. The container of claim 9 wherein each said slant is at an angle of about 30° from such perpendicular.

11. In an electrostatographic apparatus having means defining a pivotably liftable top housing top portion, an image-bearing member, and a cleaning apparatus for removing toner particles from a surface of the image-bearing member, the cleaning apparatus including:

(a) a cleaning member for contacting such surface to remove waste toner particles therefrom;

(b) a waste toner container for receiving such toner particles from said cleaning member, said container having a sump section, a front wall and a rear wall to said sump section, a plurality of partitions mounted in said sump section for defining compartments for retaining a small amount of waste toner particles, each partition being mounted slantingly at an angle of about 30° from a perpendicular between said front wall and said rear wall of said sump section.

12. The apparatus of claim 11 and including means for supporting said waste toner container for pivotable movement with the top housing portion.

13. The apparatus of claim 11 wherein said container is mounted in the said housing top portion such that the direction of slant of each said partition is towards an axis about which said housing top portion is pivotable.

14. Apparatus for cleaning a surface in an electrostatographic apparatus, said apparatus comprising:

a housing for enclosing recording components of said apparatus including said surface, said housing including a first housing member and a second housing member, the first housing member being movable relative to the second housing member;

means for removing particles from the surface to be cleaned;

means defining a container including slanted baffles within said housing for accumulating a pile of particles removed from said surface; and means for moving said container in response to movement of said first housing member so as to reduce the level of said pile adjacent said particle removing means.

15. The apparatus of claim 14 and wherein the cleaning device extends in a longitudinal direction and engages the surface being cleaned along a substantially width-wise dimension of said surface; and means for supporting the housing member for pivotable movement about an axis perpendicular to said longitudinal direction.

16. The apparatus of claims 14 or 15 and including means in said container for defining a downwardly directed ramp for guiding movement of particles from the pile when the first housing member is moved relative to the second housing member.

17. A method for cleaning a surface in an electrostatographic apparatus having a movable housing member providing access to components in said apparatus, said method comprising the steps of:

operating a cleaning device for removing residual particles from the surface to be cleaned;

collecting the particles removed from the surface in a collection container to form a pile in one portion of said container; and reducing the level of the pile formed in the said one portion in response to the movement of said housing member so as to move collected particles along slanted baffle to a second and different portion of said container.

18. The method of claim 17 and wherein the cleaning device extends in a longitudinal direction and engages the surface being cleaned along a substantially width-wise dimension of said surface, and wherein in the step of reducing the level of the pile of particles, the housing member pivots about an axis perpendicular to said longitudinal direction.

19. The method of claims 17 or 18 and wherein the movement of the housing member causes the particles to move under gravity along a downwardly directed ramp to said different portion of said container.

20. The method of claim 19 and wherein the container includes a plurality of compartments wherein a plurality of piles of particles are formed in said compartments and, in response to movement of said housing member, the levels of the piles are reduced by causing particles to flow along a plurality of downwardly directed ramps to a different portion of the container.

21. A cleaning device for use in an electrostatographic apparatus, the device comprising a cleaning member for contacting a surface of a member to be cleaned to remove particles therefrom;

a container for receiving particles removed by said cleaning member, said container including a front wall and a rear wall;

a partition member provided in the container and extending between said front wall and said rear wall for dividing the container into a plurality of compartments for receiving particles and limiting movement of particles between compartments, said partition member forming an acute angle with each of said front and rear walls.

22. The cleaning device of claim 21 and wherein the acute angle is between 30° to 60°.

* * * * *